US006729306B2

(12) United States Patent
Koegler, III et al.

(10) Patent No.: US 6,729,306 B2
(45) Date of Patent: May 4, 2004

(54) MICRO-PUMP AND FUEL INJECTOR FOR COMBUSTIBLE LIQUIDS

(75) Inventors: John M. Koegler, III, Corvallis, OR (US); John M. Da Cunha, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 74 days.

(21) Appl. No.: 10/086,002

(22) Filed: Feb. 26, 2002

(65) Prior Publication Data

US 2003/0159679 A1 Aug. 28, 2003

(51) Int. Cl.[7] ..... F02M 37/04
(52) U.S. Cl. ..... 123/497; 123/498
(58) Field of Search ..... 123/495, 497, 123/498, 446, DIG. 5, 198 C; 417/413.2, 410.2; 239/101

(56) References Cited

U.S. PATENT DOCUMENTS

| | | | | |
|---|---|---|---|---|
| 3,717,875 A | | 2/1973 | Arciprete et al. | |
| 3,961,616 A | * | 6/1976 | Brown | 123/545 |
| 4,490,728 A | * | 12/1984 | Vaught et al. | 347/60 |
| 4,549,398 A | * | 10/1985 | Oishi et al. | 60/286 |
| 4,706,644 A | * | 11/1987 | Nakai | 126/101 |
| 4,903,655 A | * | 2/1990 | Vonderau et al. | 123/198 C |
| 5,437,255 A | | 8/1995 | Sadley et al. | |
| 5,593,290 A | * | 1/1997 | Greisch et al. | 417/478 |
| 5,899,390 A | | 5/1999 | Arndt et al. | |
| 6,116,517 A | | 9/2000 | Heinzl et al. | 239/101 |
| 2002/0148449 A1 | | 10/2002 | Peng | |

FOREIGN PATENT DOCUMENTS

| | | |
|---|---|---|
| DE | 4036494 | 11/1989 |
| DE | 4409805 | 7/1995 |
| EP | 0999055 A2 | 5/2000 |
| EP | 0999055 A3 | 10/2000 |
| JP | 10018939 | 1/1998 |
| WO | WO 00/32927 | 6/2000 |
| WO | WO 01/92715 | 12/2001 |
| WO | WO01/92715 A1 | 12/2001 |

* cited by examiner

*Primary Examiner*—Mahmoud Gimie

(57) ABSTRACT

A micro-pump for fuel injection includes a housing, a pressure regulator, a combustible liquid inlet conduit in fluid communication with the pressure regulator, and a drop ejector on the housing and in fluid communication with the pressure regulator. The drop ejector contains a nozzle capable of ejecting a combustible liquid in a drop-by-drop fashion from the drop ejector. Further, an apparatus for generating a combustible vapor for a combustible fuel device such as an internal combustion engine. The apparatus includes a micro-pump for ejecting a combustible liquid drop-by-drop therefrom and means, connected to the micro-pump, for channeling a stream of air through the drops ejected by the micro-pump thereby generating a combustible vapor for the combustible fuel device.

45 Claims, 7 Drawing Sheets

MICRO-PUMP AND FUEL INJECTOR FOR COMBUSTIBLE LIQUIDS

BACKGROUND

The present invention generally relates to engine fuel systems and, more particularly, to combustible fuel devices that generate combustible vapors such as internal combustion engines.

Heretofore, combustible vapors were directed into the cylinders of internal combustion engines using either carburetors or fuel injectors. Fuel injectors were either continuous or pulsed. The continuous fuel injectors directed the combustible vapor into an intake manifold, and when an intake valve opened, the vapor was drawn into the cylinder by the piston. The pulsed fuel injectors directed fuel vapor on command into either a region upstream of each intake valve or directly into the combustion chambers. Both of these fuel delivery systems are highly developed, well known, and have been in use for decades.

By way of further background, the engine fuel system disclosed in this document also generally relates to a printing/imaging technology known as thermal ink jet or bubble jet. For printing marks and text on various media with water based inks, this technology is likewise well known and highly developed.

As environmental regulations become more and more stringent, there is an increasing need for more precise control of the fuel/air stoichiometry in the combustion chambers of an engine. Several problems continue to persist in conventional fuel delivery technology. For instance, if excessive fuel is used or too little air, the amount of hydrocarbon emissions increases correspondingly. Also, for fuel injectors, the orifices change in size over time; they get larger due to mechanical wear and smaller due to clogging from both the constituents in the fuel and small particles that are not removed by the fuel filter. In addition, the requirement for more precise fuel and air metering to meet environmental and fuel economy regulations has caused both carburetors and fuel injectors to become more and more expensive.

There is also a need for an inexpensive, simple fuel delivery system for small industrial engines, those having about twenty-five horsepower or less. These are the engines used on lawn mowers, rotary tillers, outboards, and scooters, for example. These engines are increasingly being subject to environmental regulation, but it is impractical to incorporate a conventional fuel delivery system that costs as much or more than the rest of the machine.

Further, with these conventional fuel delivery systems, reliability continues to be a problem. For example, a conventional fuel injection system requires high-pressure pumps and carefully engineered fuel conduits, tubing, and connections that must withstand constant vibration and extreme variations in operating temperature.

It is apparent from the foregoing that although there are well-developed engine fuel delivery systems, there is a need for an approach that meets increasingly stringent environmental regulations, is reliable and inexpensive, and more precisely controls the fuel/air stoichiometry in combustion chambers.

SUMMARY

Briefly and in general terms, an apparatus according to the invention includes a micro-pump having a housing, a pressure regulator connected to the housing, a combustible liquid inlet conduit in fluid communication with the pressure regulator, and a drop ejector on the housing and in fluid communication with the pressure regulator. The drop ejector contains a nozzle capable of ejecting a combustible liquid in a drop-by-drop fashion from the drop ejector.

Another aspect of the invention is an apparatus for generating a combustible vapor including a micro-pump for ejecting a combustible liquid drop-by-drop therefrom and means, connected to the micro-pump, for channeling a stream of air through the drops ejected by the micro-pump thereby generating a combustible vapor for combustible fuel devices such as an internal combustion engine.

In operation, the apparatus ejects a combustible liquid drop-by-drop from a micro-pump and channels a stream of air through the drops ejected by the micro-pump, thereby generating a combustible vapor.

Other aspects and advantages of the invention will become apparent from the following detailed description, taken in conjunction with the accompanying drawings, illustrating by way of example the principles of the invention.

BRIEF DESCRIPTION OF THE DRAWINGS

The invention is better understood with reference to the following drawings. The elements of the drawings are not necessarily to scale relative to each other. Rather, emphasis has instead been placed upon clearly illustrating the invention. Furthermore, like reference numerals designate corresponding similar parts through the several views.

DETAILED DESCRIPTION

Figure 12:
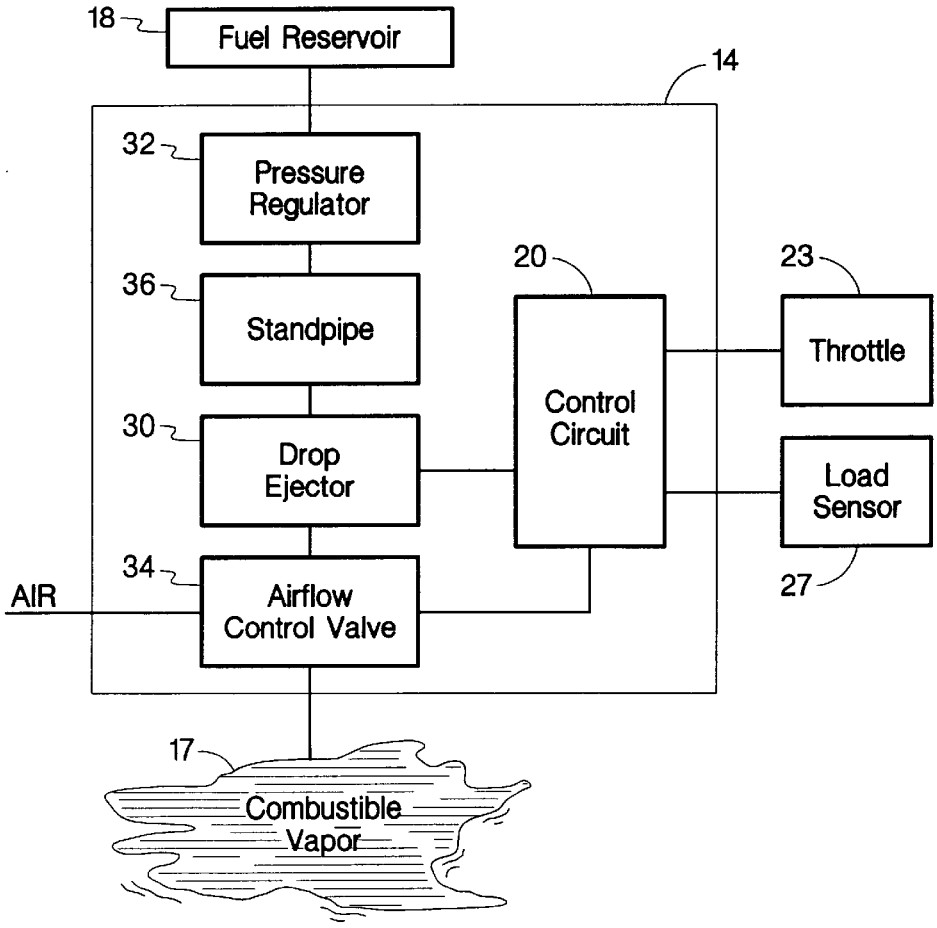
FIG. 12 is a block diagram of an exemplary embodiment of the invention.

As shown in the drawings for the purposes of illustration, the invention is embodied in a micro-pump for delivering combustible liquids, an apparatus for generating a combustible vapor for a combustible fuel device such as an internal combustion engine, its method of control and operation, and its control circuit. FIG. 12 is a block diagram of one embodiment of the invention. A fuel injector 14 includes a drop ejector 30 and an airflow control valve 34. The drop ejector 30 creates discrete numbers of drops of a substantially fixed quantum of size. The drop ejector 30 is fluidically connected preferably under low pressure to a fuel reservoir 18 containing combustible fuel. The fuel from the fuel reservoir 18 is preferably delivered to the drop ejector using a pressure regulator 32 and an optional standpipe 36 to prevent fuel leakage from the drop ejector 30 in non-use situations. Preferably, the drop ejector 30 is removable and replaceable by a typical consumer. A control circuit 20 controls the drop ejector 30 and airflow control valve 34. The control circuit 20 is preferably connected to a throttle 23 controlled by a user and a load sensor 27 that monitors and senses the load of a combustible fuel device. The airflow control valve 34 regulates the flow of air that is mixed with the fuel ejected from the drop ejector 30 to create a combustible vapor 17 used the combustible fuel device.

The apparatus offers an inexpensive, simple, reliable, electro-mechanical fuel delivery system for precisely controlling the fuel/air stoichiometry in the cylinders of an internal combustion engine or other combustible fuel devices such as lamps, stoves, generators, and portable heaters to name a few. The apparatus has the capability of precisely metering how much fuel is being delivered to the cylinders or devices with a resolution in a range of nanograms because both the size and weight of the drops of fuel being delivered by the micro-pump are precisely controlled in a discretely drop-by-drop manner. These features allow the engine or device to reduce the amount of hydrocarbons released into the atmosphere, in particular during start-up, and to meet increasingly stringent environmental regulations. The apparatus differs from conventional fuel injectors in that rather than forming a spray of fuel having varying drop sizes, a drop-by-drop generator in the micro-pump creates one or more quantums of fuel in fixed sized drops that are discretely ejected and that are readily vaporized when mixed with air. This ability to provide a fixed amount of fuel made up of a various amounts of quantum sized drops creates a method of digitally delivering fuel to an engine, thus allowing for enhanced automated and preferably computerized control. By being able to efficiently blend the fuel and air, one benefit is that for a given application, lower grade fuels may be used thus leading to further economy.

In addition, the apparatus includes a low pressure, e.g. less than about 3 pounds per square inch, fuel supply system. This low-pressure fuel supply system operates far below the high pressures found in conventional fuel injection systems. The drop-by-drop generator (hereinafter called a drop generator) includes micro nozzles and capillary channels within a standpipe that are custom designed and sized for the type of fuel used. By adding a back pressure regulator between the drop generator/standpipe and the low pressure fuel delivery system, fuel is prevented from leaking into the engine. Preferably, the apparatus is designed to allow the drop generator to be easily replaceable by a consumer. This exchangeability of the drop generator allows for easy maintenance of a fuel injection system, such as when the nozzles become clogged due to impurities in the fuel. Also, by allowing for removal and replacement of the drop generator, various fuel types can be used in a given device and the proper drop ejector for the fuel type selected is simply exchanged and installed.

Figure 11:
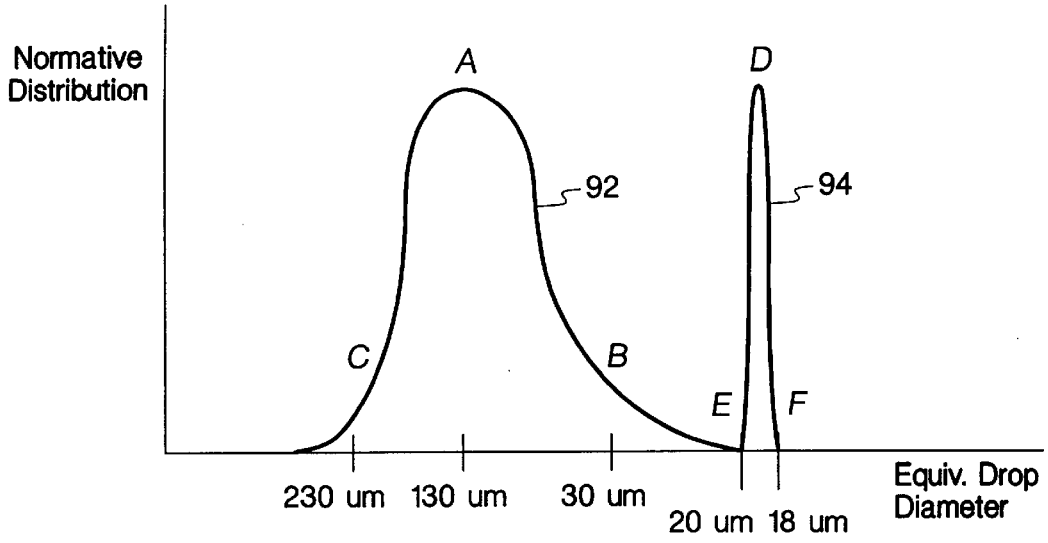
FIG. 11 is an exemplary equivalent drop diameter distributions for a conventional fuel injector and an embodiment of the apparatus of FIG. 1

Because combustion is related to the active surface area of the fuel consumed, usually most fuel injectors are characterized by their equivalent spherical diameter that is defined by the surface area per unit volume to the full distribution. This equivalent spherical diameter is also known as the Sauter Mean Diameter (SMD) and it is the widely preferred method of the industry to describe injector droplet size rather than the mean volume diameter because it does not give extra statistical weight to larger droplets. Accordingly, the SMD is an approach of expressing the fineness of a spray in terms of the surface area produced by the spray. Therefore, the SMD is the diameter of a drop having the same volume-to-surface area ratio as the total volume of all the drops to the total surface area of all the drops. In practice, this leads to a number that is skewed toward the finer end of the distribution. Therefore, examining a quoted SMD number from a manufacturer does not determine the actual range of droplet sizes from a particular fuel injector. FIG. 11 is a chart describing the normalized distributed equivalent drop diameters for a conventional injector distribution 92 and an exemplary apparatus distribution 94 of the invention. A conventional injector distribution 92 has a mean volume diameter A of about 130 um with a distribution of droplets having large diameters C of about 230 um and small diameters B of about 30 um. Thus, even though conventional injectors may be cited as having an SMD of about 30 um, larger droplets are typically formed and not always fully burned, leading to increased emissions and decreased fuel economy.

The apparatus described herein instead has a method of creating discrete quantum sized drops that can be independently or simultaneously ejected. In the exemplary described apparatus, the apparatus distribution 94 as shown in FIG. 11 has a very narrow drop distribution between E and F of about 2 um for a particular embodiment. Because of the narrow (near uniform) distribution of ejected drops from the apparatus of the invention, the Number Median Diameter (NMD) is the preferred method of describing aerosol size in this application. The NMD indicates that the physical diameter of 50% of the aerosol droplets is less than the NMD and that 50% are greater than the NMD. For instance in FIG. 11, the NMD of the exemplary apparatus drop size is about 19 um. For conventional injector distribution 92 the NMD is about 130 um in FIG. 11. In the invention's drop generator, the size of the droplets can be individually designed to provide drop NMD diameters anywhere less than about 1 mm but preferably less than 30 um. The volume of the drop sizes for the apparatus of the invention can be even as low as 10 picoliters and further down to about 70 femtoliters.

Research has shown that total tailpipe unburned hydrocarbon emissions can be reduced, especially during the first minutes of operation when the SMD is reduced below 10 um. The high amounts of unburned hydrocarbon emissions following cold start are mainly unburned fuel and not partial oxidation products such as CO and NO. One problem with the large drops formed using conventional injectors during start-up is "wall-wetting" wherein the fuel that is not vaporized and mixed in the air attaches to the wall of the cylinder. Another is that the engine walls are cold and absorb energy from the combustion, thus the fuel in unable to burn fully during a firing cycle. Because most fuel control systems cannot adequately control load changes when the engine is cold, the amount of fuel used during a cold start is increased to prevent problems with lean fuel burns. All of these factors contribute to fuel being absorbed into the engine oil layers and other deposits and prevent the fuel from being fully oxidized during the normal combustion cycle. This problem is further exacerbated when fuels heavier than gasoline are used, such as diesel and kerosene. In general, heavier droplets of fuel are more likely to reach the cylinder in a liquid state. Conventional approaches to achieving a smaller drop size have explored using fine spray injectors, however, these injectors do not have a uniform drop size and instead have a wide distribution of fuel droplet diameters, such as 250 um to 30 um in diameter. Generally, these fine spray injectors use an air stream to breakup the injector fuel stream. Other approaches have used heated injectors to partially or fully vaporize the fuel stream.

Figure 1:
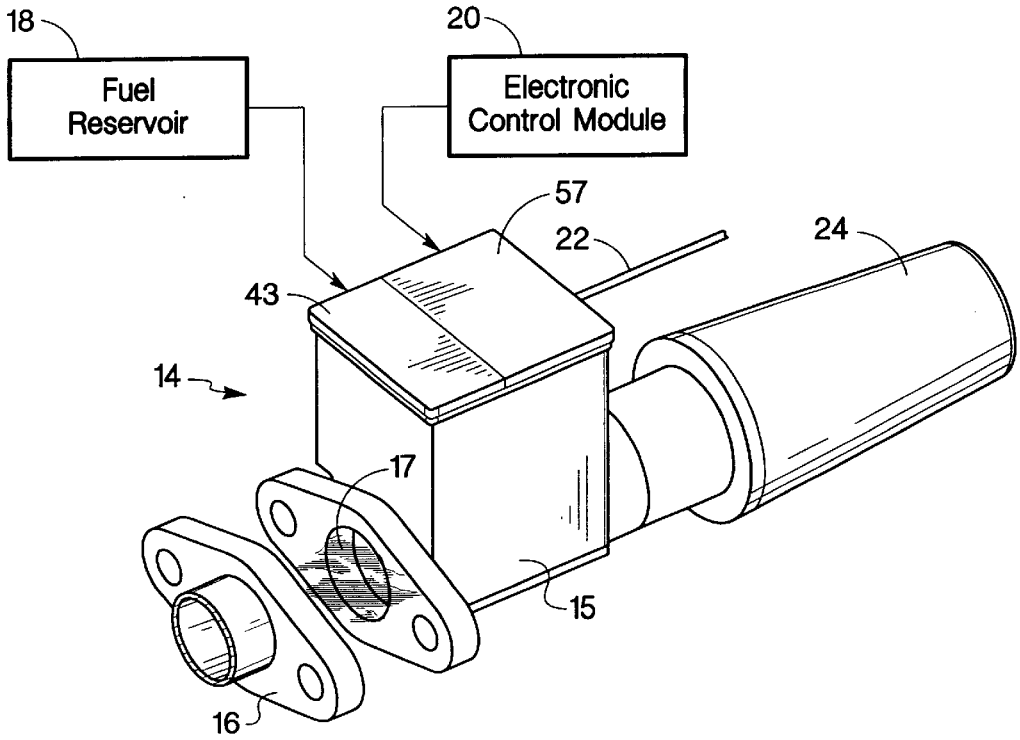
FIG. 1 is a top, side, and perspective view, partially diagrammatic, of an apparatus for generating a combustible vapor for an internal combustion engine embodying the principles of the invention.
Figure 2:
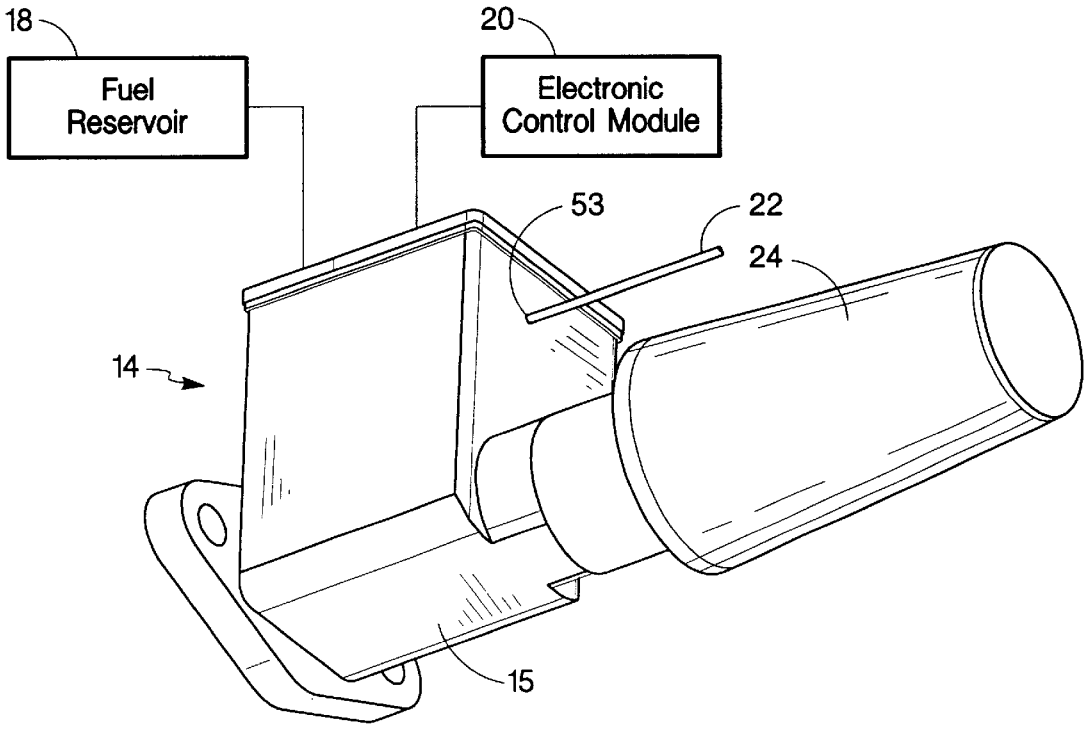
FIG. 2 is a bottom, side, and perspective view, partially diagrammatic of the apparatus of FIG. 1.

Referring to FIGS. 1 and 2, reference numeral 14 generally indicates an apparatus for generating a combustible vapor for an internal combustion engine, hereinafter called a "fuel injector" for brevity. The fuel injector has a main body 15 that is mounted either on an intake manifold 16 or proximate to the intake valves, not shown, of an internal combustion engine. The main body 15 and all of the parts, unless noted otherwise in this document, are preferably made of Nylon 6, an injected molded polymer that is resistant to gasoline and other engine fuels. The fuel injector can be used on either 2 cycle or 4 cycle spark ignition engines or 2 cycle or 4 cycle compression ignition engines. The function of the fuel injector is to produce very small, metered quantum or digital drops of combustible fuel and to channel a controlled amount of air through the drops and thereby generate a combustible vapor 17. The combustible vapor is drawn into the cylinders of the engine by either the vacuum created by the motion of the piston(s) or by an exterior air pump, not shown, such as a supercharger and/or a turbocharger.

In FIGS. 1 and 2, connected to the main body 15 is a fuel reservoir 18. The fuel reservoir may or may not be connected to a fuel pump, not shown, but gravity feed of the fuel is inexpensive and is preferable because only a minimal fuel pressure is required for the fuel injector. The fuel can be any type of gasoline, Diesel fuels, alcohols, fuel oils, and kerosenes, in short, any combustible fuel or fuel combination that will power an internal combustion engine or other combustible fuel device such as light sources (e.g. lanterns), furnaces, stoves, heaters and generators, to just name a few.

In FIGS. 1 and 2, the fuel injector 14 is connected to an electrical control module 20. This module and its functions are described below in connection with FIG. 10. Reference numeral 22 indicates a throttle cable that is connected to either a manual throttle or a foot pedal, not shown. As described below, when the throttle cable 22 is pulled away from the main body 15, the fuel injector 14 channels a greater volume of air through the apparatus and into the engine. A conventional air filter 24 removes any particulate matter in the air stream entering the fuel injector 14 thus filtering the air.

Figure 3:
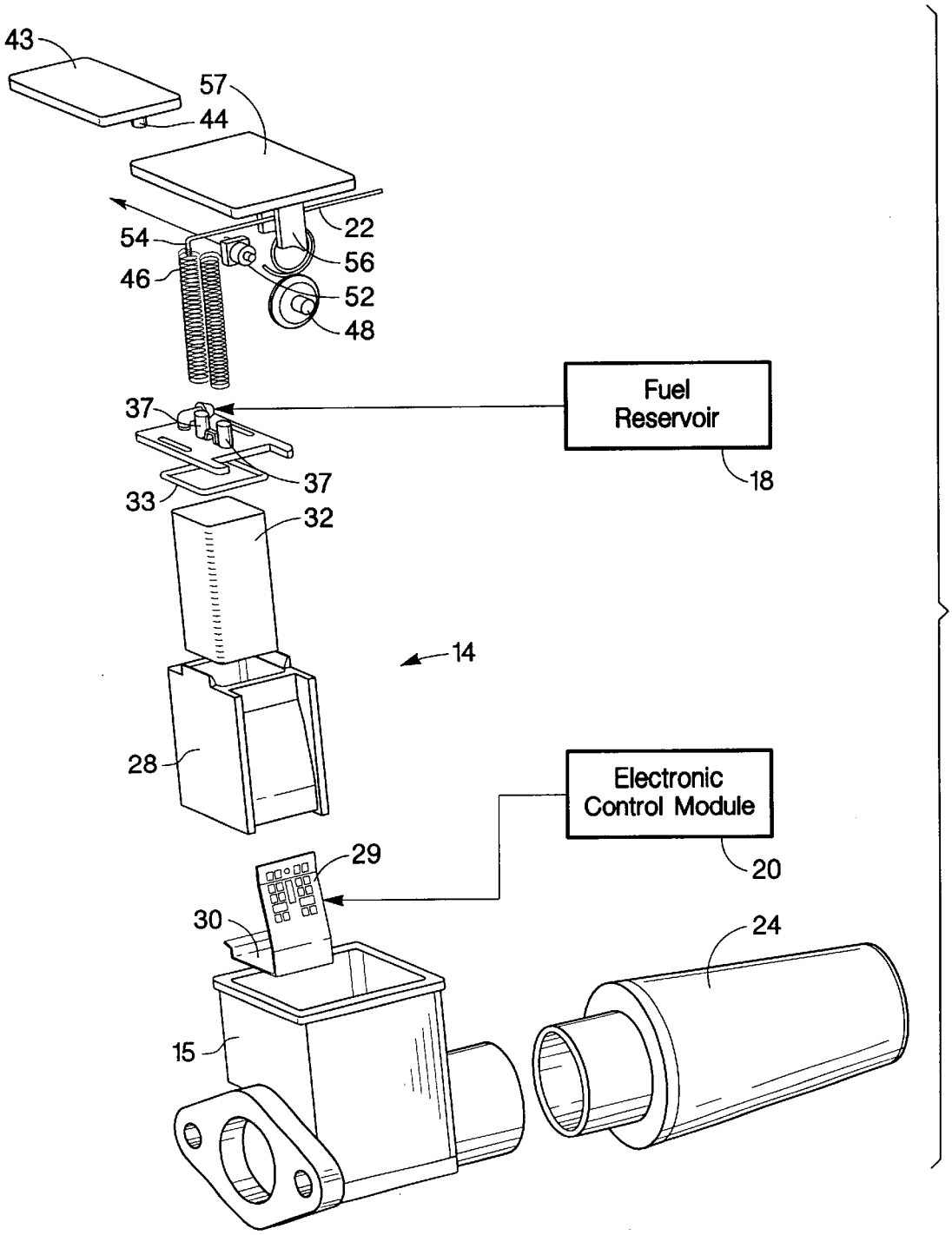
FIG. 3 is an exploded view, partially diagrammatic, of the apparatus of FIG. 1.
Figure 8:
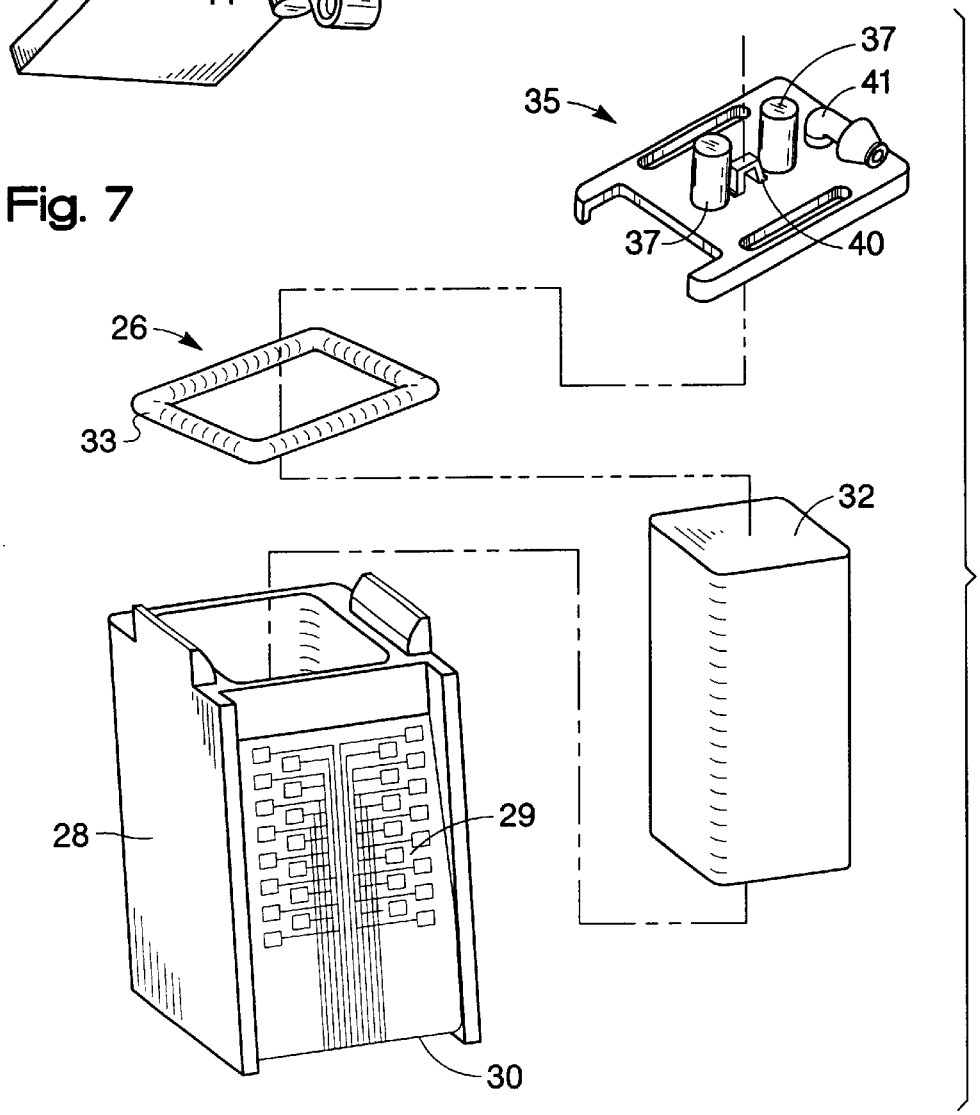
FIG. 8 is an exploded view of the micro-pump of the apparatus of FIG. 1.
Figure 10:
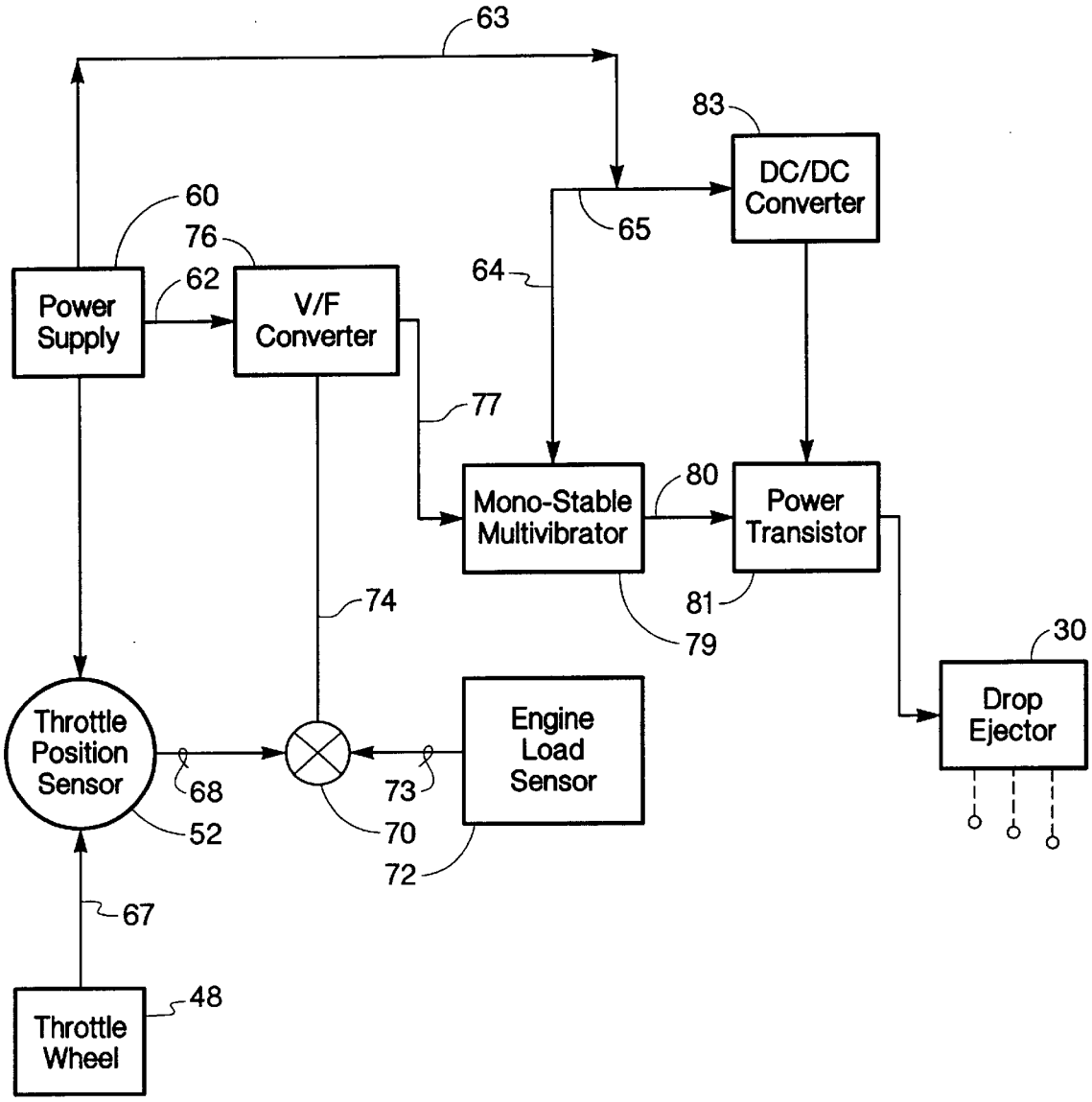
FIG. 10 is a block diagram of the signals and the electrical control circuit for the apparatus of FIG. 10.

Referring to FIG. 8, reference numeral 26 generally indicates a slide body, preferably replaceable, that functions both as a micro-pump for the fuel and an air control valve that regulates the amount of air that is directed into the stream of fuel droplets produced by the micro-pump. The slide body 26 is constructed similar to and operates in essentially the same manner as a thermal ink jet print cartridge. However, the various properties of the desired fuel used, such as surface tension, chemical reactivity, and volatility, to name a few, require that modifications be made to the design of conventional thermal ink jet print cartridges and thus prevents simply replacing ink with fuel. Such changes include reducing the capillary sizes in the standpipe between the backpressure regulator and the drop generator to account for a lower surface tension. Other changes include selection of materials for the body and backpressure regulator that are resistant to the fuel's solubility, such as nylon 6. Further, the backpressure regulation must be adapted to account for the higher volatility of the fuel. In this exemplary embodiment, the slide body 26 includes a housing 28 on which is mounted a TAB circuit 29. Other forms of interconnection are known to those skilled in the art and can be substituted for the TAB circuit 29 and still remain within the spirit and scope of the invention. The TAB circuit 29 is electrically connected to the electronic control module 20 described below in connection to FIG. 10. The TAB circuit 29 is also electrically and physically connected to a drop ejector 30, the drop-by-drop generator, located on the bottom wall of the housing 28. An exemplary drop ejector is described in U.S. Pat. No. 6,162,589 entitled "Direct Imaging Polymer Fluid Jet Orifice" issued on Dec. 19, 2000 to Chen et al, and herein incorporated by reference. The drop ejector 30 contains a plurality of fuel firing chambers; each firing chamber has one or more nozzles, a fuel inlet channel, and an energy dissipation element, such as a resistor or flextentional device that is pulsed by the electronic control module 20. The electronic control module 20 is preferably responsive to engine load and throttle position when embodied in an internal combustion engine application. The drop ejector 30 expels the combustible liquid drop-by-drop for each orifice vertically downward (in this embodiment, although any orientation is possible) from the firing chambers as illustrated in FIGS. 3, 8, and 10. For gasoline, the drops each have an NMD of less than about 30 microns and a volume of about 14 picoliters, although this can be tailored depending on the design of the drop ejector such as up to an NMD of 1 mm.

Within the housing 28 of FIG. 8 is a pressure regulator 32 that can be either reticulated foam as illustrated or a spring bag or a flexible diaphragm. Several other pressure regulators for controlling back pressure are known to those skilled in the art and can be substituted and still fall within the scope and spirit of the invention. The pressure regulator is in fluid communication with the drop ejector 30 through a slot or slots in the standpipe (not shown) located in the bottom of the housing 28. The pressure regulator places a slight negative pressure on the backside of the drop ejector 30 so that the combustible fluid does not leak or dribble out of the drop ejector.

Figure 6:
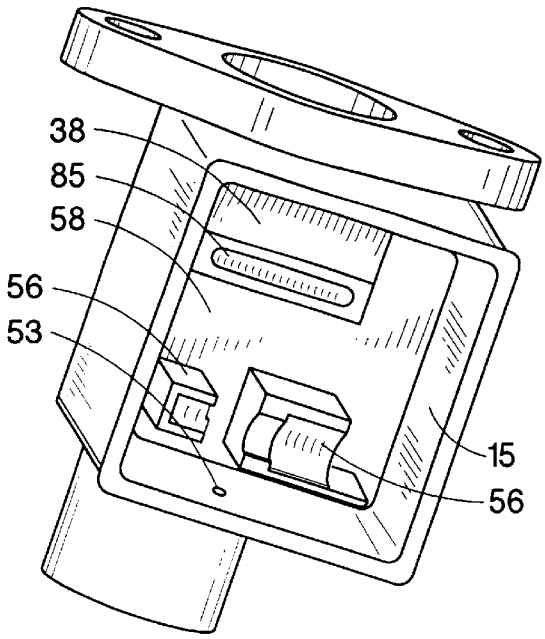

The slide body 26 of FIG. 8 also includes a slide body top 35, and the housing 28 and the top 35 are sealed with a gasket 33 so that the combustible liquid does not leak out of the slide body. The gasket is preferably made from EPDM or polyurethane. On the top wall of the slide body top 35 are two cylindrical features 37 that retain the compression return springs 46 (FIG. 3) in place and an arch 40. The throttle cable 22 (FIG. 1) is connected to the arch 40 as described below and the motion of the throttle cable causes the slide body 26 to move vertically up and down within a slot 38 (FIG. 6) within the main body 15 of the fuel injector to control the amount of air entering the fuel injector through airway 85 (see FIG. 6).

Also located on the top wall of the slide body 26 (see FIG. 8), is a combustible fuel inlet conduit 41 that is in fluid communication with the fuel reservoir 18 (FIG. 1). Within the main body 15, the fuel inlet conduit 41 is flexible and resiliently deformable so that the slide body 26 can move up and down within the fuel injector without obstruction. The fluid inlet conduit 41 is also in fluid communication with the pressure regulator 32 (FIG. 8).

Figure 7:
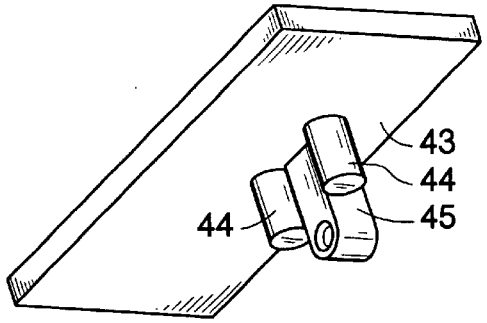
Figure 9:
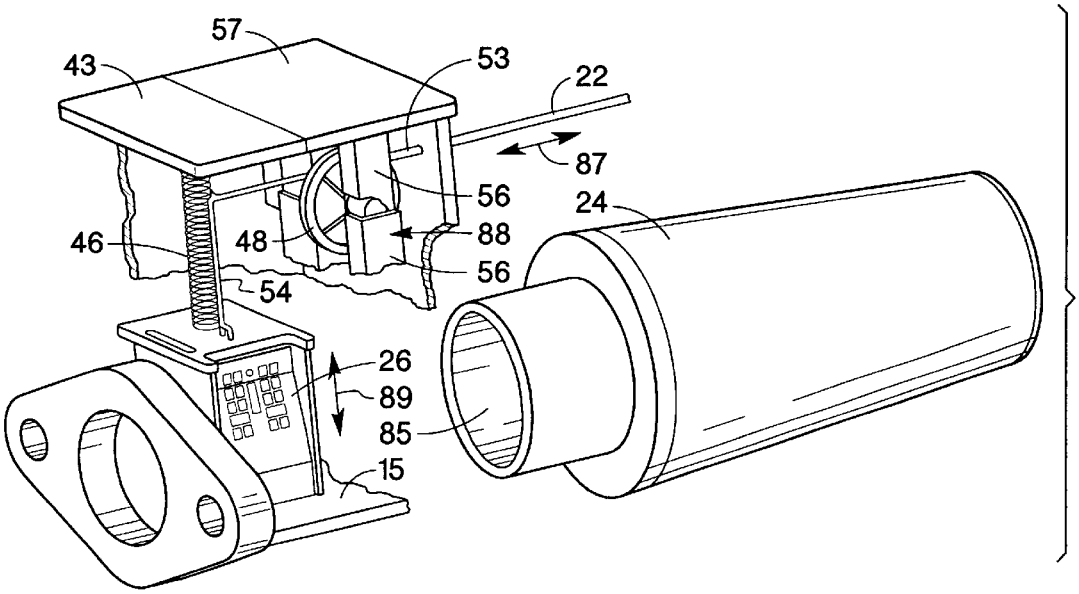
FIG. 9 is a perspective view, partially cut away, of the apparatus of FIG. 1.

Referring to FIGS. 7 and 9, reference numeral 43 indicates a rearward portion of the top wall of the main body 15. Located on the bottom side of this wall 43 (FIG. 7) are two spaced apart cylindrical features 44. After assembly of the fuel injector, these cylindrical features 44 are co-axial with the cylindrical features 37 on the slide body top 35 (FIG. 8). The four features together engage and retain two return springs 46 (FIG. 3). The return springs 46 are compression springs and are preferably fabricated from stainless steel. The return springs urge the slide body 26 downward into the main body 15 and into a position that blocks the flow of air through the fuel injector 14. When the slide body 26 is pulled upward by the throttle cable 22, the return springs 46 are compressed. Also located on the bottom side of the top wall 43 is a guide 45 for the throttle cable 22, 54. The function of the guide 45 is to make the throttle cable bend 54, as illustrated in FIGS. 3 and 9. For clarity the guide 45 is not illustrated in FIGS. 3 and 9.

Figure 4:
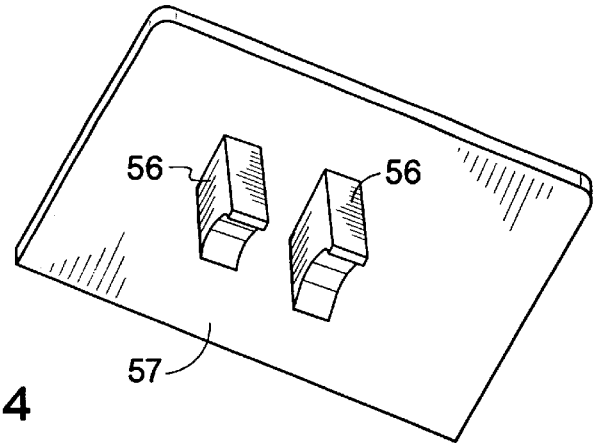
FIGS. 4–7 are perspective views of some of the components of the apparatus of FIG. 1
Figure 5:
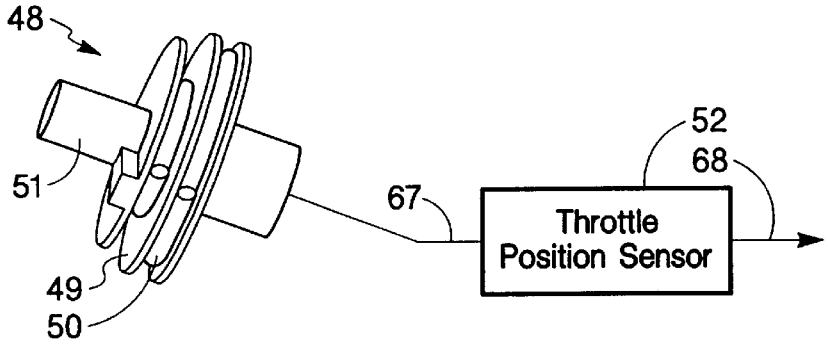

Referring to FIG. 5, reference numeral 48 generally indicates a throttle wheel. The throttle wheel has a smaller spool 49 and a larger spool 50 rigidly mounted on an axle 51. The throttle cable 22 (FIG. 1), connected to the throttle, not shown, passes through a small hole 53 (FIG. 6) in the main body 15 and is wrapped around the larger spool 50. There is a second cable 54 that is wrapped around the smaller spool 49. The second cable 54 passes through the guide 45 (FIG. 7) and is connected to the arch 40 on the slide body top 35 (FIG. 8). The function of the two spools 49, 50, of different diameters is to reduce the overall height of the fuel injector 14. Also, connected to the axle 51 is a throttle position sensor 52, preferably a potentiometer. This sensor measures the radial position of the throttle wheel 48 that corresponds to the vertical position of the slide body 26 within the fuel injector 14. The sensor sends a position signal 68 to the control circuit (see FIG. 10) described below. The throttle wheel 48 is mounted for rotation on four forks 56 in FIGS. 4 and 6. Two of the forks 56 are located on the bottom of the forward portion 57 of the top wall of the main body 15. The other two forks 48 are located on a medial wall 58 within the main body 15.

FIG. 10 illustrates an exemplary electronic control circuit and the flow of signals within the electronic control module 20 (FIG. 1). The electronic control circuit may be designed and built using analog, digital, or any combination thereof of electrical circuits, including microprocessors. The circuit includes a twelve-volt DC power supply 60 that supplies power to all of the electronics for the fuel injector 14. The power supply can either be a battery or a generator driven by the engine. Arrows 61–65 inclusive indicate the twelve-volt DC power distributed to the various sub-circuits.

The throttle wheel 48 illustrated in FIGS. 5 and 10 turns in response to the movement of the throttle cable 22, 54, and the position of the axle 51 is indicated by the arrow 67. The radial position of the throttle wheel 48 and, in turn, the vertical location of the slide body 26 (FIG. 8), within the main body 15 is measured by the throttle position sensor 52, typically and preferably a positioning potentiometer. Arrow 68 is a variable voltage corresponding to the vertical position of the slide body 26 in the fuel injector and, in turn, the size of the opening of the airway in the fuel injector. This variable voltage is an input to a summing junction 70.

Reference numeral 72 of FIG. 10 indicates an engine load sensor. The load sensor can take many forms depending on the application. In one application the sensor is a tachometer that measures the revolutions per minute of the engine. In another application the sensor is an airflow meter that measures the quantity of air entering the fuel injector. On an air-cooled engine the sensor is a flow meter measuring the amount of air being moved by the fan. The output voltage signal from the engine load sensor 72 is indicated by arrow 73 and is a second input to the summing junction 70.

The summing junction 70 of FIG. 10 combines the input from the throttle position indicated by arrow 68 and the input from the load on the engine, i.e., the revolutions per minute of the engine or the airflow as indicated by arrow 73. The output of the summing junction is a variable DC voltage as indicated by arrow 74. This variable DC voltage is an input to either an analog or digital voltage to frequency converter 76, hereinafter, V/F converter for brevity. The function of the V/F converter is to modulate the amount of combustible fuel being ejected from the drop ejector 30 (see FIGS. 3 and 10). The output signal from the V/F converter 76, indicated by arrow 77, is a signal having a frequency directly related to the output of the summing junction 70.

The signal indicated by arrow 77 is the input to a mono-stable multivibrator 79. The multivibrator 79 converts the variable frequency waveform produced by the voltage to frequency converter 76 into an output 80 that is preferably a train of pulses having a variable frequency, constant pulse width, and constant pulse height which create the quantum drops thus allowing for digital delivery of the fuel in discretely ejected drops of substantially uniform NMD size. The pulse train is an input, indicated by arrow 80, to an output power transistor 81. The power transistor drives the drop ejector 30 with a train of pulses of the same configuration received from the multivibrator 79, variable frequency, constant pulse width and constant pulse height, but with higher power. The DC-to-DC converter 83 raises the output voltage of the power transistor 81 from the twelve volts from the power supply 60 to that required by the energy dissipation elements within the drop ejector 30. The power transistor 81 is connected directly to the drop ejector 30 by the TAB circuit 29 (FIG. 3) using frequency drive control. Drop ejector 30 may include a set of one or more nozzles arranged in organized or chaotic array patterns.

The flow path of air through the fuel injector 14 (FIG. 2) begins at the air filter 24. Air is drawn into the fuel injector either by an air pump, not shown, or by the vacuum created by the motion of the pistons in the engine. Air flows through the air filter 24, down the airway 85 (FIG. 6) in the main body 15, beneath the drop ejector 30 (FIGS. 3 and 8) on the slide body 26, out of the main body 15, and into the intake manifold 16 (FIG. 1). The airflow is from right to left in FIG. 1.

The flow path of the combustible liquid begins at the fuel reservoir 18 (FIG. 1). The liquid flows in a low pressure conduit (e.g. less than about 3 psi) from the reservoir to the main body 15, then through a resiliently deformable conduit at a low pressure (e.g. again less than about 3 psi) to the fuel inlet 41 on the slide body 26 (FIG. 8). The liquid flows through the pressure regulator 32, through several slots in the standpipe (not shown) in the bottom of the housing 28 to the drop ejector 30. The exemplary pressure regulator, preferably foam, maintains a slight negative pressure (relative to gauge thus creating a backpressure) at the back of the drop ejector so that the combustible liquid does not drool or run out of the drop ejector 30 during non-use. The liquid fuel is drawn out of the foam and into the drop ejector because of the capillary action of the fluid within the drop generator and standpipe slots to replace the ejected volume. The drop ejector 30 fires the liquid drop-by-drop vertically downward into a fast flow of air channeled beneath the slide body 26. When the drops reach the air stream, their flight path changes from vertical to horizontal in this example. The drops are sufficiently small due to their discretely ejected quantum size. The airflow is designed such that mixing occurs between the air and the quantum drops of fuel and a combustible vapor 17 (FIG. 1) is formed.

Referring to FIG. 9, motion of throttle cable 22, as indicated by the arrow 87, causes the throttle wheel 48 to rotate, as indicated by the arrow 88, and the slide body 26 to move up and down, as indicated by the arrow 89. The slide body 26 normally sits at the bottom of the slot 38 (FIG. 6), blocking the airway 85 and is urged downward by the return springs 46 (FIG. 3). When the throttle cable 22 is pulled away from the main body 15, the cable 22 causes the throttle wheel 48 to rotate and in turn and thus pull the slide body 26 upward with the second throttle cable 54. The second throttle cable passes through the guide 45 (FIG. 7) and its motion is redirected from horizontal to vertical as illustrated in FIG. 9. The second throttle cable is attached to the arch 40 on the slide body top wall 35 (FIG. 8). When the slide body moves upward, more of the airway 85 is uncovered and more air is permitted to flow into the fuel injector 14. In addition, the return springs 46 are compressed. The rotation of the throttle wheel 48 also actuates the throttle position sensor 52 that sends a signal 68 to the electronic control module 20 indicating that more of the airway 85 is open and more air is flowing into the fuel injector.

The circuit illustrated in FIG. 10 functions to control the rate at which the drop ejector 30 fires, i.e., the speed at which drops of combustible liquid are introduced into the air stream within the fuel ejector, thus ultimately the volume of fuel delivered from the fuel injector.

When the throttle cable 22 (FIG. 1) is pulled away from the fuel injector, the output signal 68 from the throttle position sensor 52 increases and the voltage level 74 to the voltage to frequency converter 76 increases. In turn, the output frequency 77 of the V/F converter 76 increases. The pulse height and pulse width remain constant. The increased frequency of pulses causes the mono-stable multivibrator 79 and the power transistor 81 to fire the drop ejector faster, thereby injecting more drops of combustible fluid into the air stream, although each drop remains substantially the same quantum of size. If the throttle cable 22 is relaxed, the return springs 46 (FIG. 9) urge the drop ejector 30 downward and the output signal 68 from the throttle position sensor 52 decreases. In turn, the voltage level 74 to the V/F converter 76 decreases, the output frequency of pulses from the V/F converter 76 decreases, and the drop ejector 30 fires at a slower rate.

When the engine is running at steady state and an increased load is placed on the engine, the speed of the engine slows and also the flow of air through the fuel injector decreases. Either the decrease in revolutions of the engine or the decrease in airflow or both are sensed by the engine load sensor 72 and the output voltage signal 73 to the summing junction 70 changes to compensate for the additional load. This change in turn causes the input voltage 74 to the V/F converter 76 to increase and the circuit causes the drop ejector 30 to fire faster. As more combustible liquid is ejected into the air stream, the engine typically produces more torque up to a certain point where the combustible mixture becomes too rich and it does not increase torque any longer. This process all occurs without moving the throttle cable 22. Alternatively, the load sensor may also affect the throttle position. If the increased load is removed, the engine typically speeds up since excess power is being generated, and the circuit operates to reduce the firing frequency of the drop ejector 30. This is just the reverse of the process described immediately above.

Referring to FIG. 10, the summing junction 70 combines the output voltage 68 from the throttle position sensor 52 and the output voltage 73 from the engine load sensor. The combined signal is the input voltage level 74 to the V/F converter 76 and in turn causes the circuit to increase or decrease the firing frequency of the drop ejector 30. In particular, at steady state the position of the slide body 26 (FIG. 9) within the fuel injector determines the primary stoichiometry ratio of the air stream and the air charge going into the engine. During acceleration and deceleration, the engine load sensor 72 modifies the stoichiometric ratio.

Under conditions of a very small load, as the slide body 26 opens the airway 85, more air is permitted to enter the fuel injector 14. Because there is very little load on the engine, the speed of the engine responds very quickly and the revolutions of the engine come up to speed very easily. In this situation of low load, the output signal 73 from the engine load sensor 72 has very little affect on the frequency of the pulses produced by the V/F converter 76 and, in turn, the firing frequency of the drop ejector 30.

Under conditions of increased load, as the engine load increases and without changing the throttle position, the output voltage signal 73 from the engine load sensor 72 changes the voltage at the summing junction 70 (FIG. 10). The load sensor causes the output 74 voltage from the summing junction 70 to increase, and that, in turn, causes the frequency of pulses produced by the V/C converter 76 to increase, thereby increasing the firing rate of the drop ejector 30. More drops of combustible liquid are injected into the air stream and the stoichiometric ratio is changed to increase the torque produced by the engine. The engine thus responds to the load and equilibrium is reestablished.

While the present invention has been particularly shown and described with reference to the foregoing preferred and alternative embodiments, those skilled in the art will understand that many variations may be made therein without departing from the spirit and scope of the invention as defined in the following claims. For example, a stationary drop ejector located in the airway can be used and the flow of air into the fuel injector controlled by an airflow control valve such as a butterfly valve.

This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements The invention is limited only by the following claims.

We claim:

1. A micro-pump for fuel injection, comprising:

a housing;

a pressure regulator connected to the housing;

a combustible liquid inlet conduit in fluid communication with the pressure regulator; and a drop ejector on the housing and in fluid communication with the pressure regulator, said drop ejector containing a nozzle capable of ejecting a combustible liquid in a drop-by-drop fashion from the drop ejector.

2. The micro-pump of claim 1 wherein the drops expelled by the drop ejector have a number mean diameter suitable for producing combustion and of less than about 1 mm.

3. The micro-pump of claim 1 wherein the micro-pump is in fluid communication with an internal combustion engine and the drop-by-drop output of the drop ejector varies in accordance with the power requirements of the internal combustion engine.

4. The micro-pump of claim 1 having a plurality of nozzles that are individually stimulated to produce drops at variable firing frequency.

5. The micro-pump of claim 4 wherein the firing frequency varies in accordance with the power requirements of an internal combustion engine.

6. The micro-pump of claim 1, wherein said drop ejector includes a plurality of firing chambers and a plurality of corresponding energy dissipation elements configured to selectively cause drops of combustible fluid to be ejected from said firing chambers.

7. The micro-pump of claim 6, wherein said energy dissipation elements are resistors.

8. An apparatus for generating a combustible vapor, comprising:

a micro-pump for ejecting a combustible liquid drop-by-drop therefrom; and means, connected to the micro-pump, for channeling a stream of air through the drops ejected by the micro-pump thereby generating the combustible vapor.

9. The apparatus of claim 8 further including means, connected to the micro-pump, for positioning the micro-pump with respect to the air channeling means and thereby determining the volume of air channeled by the pump.

10. The apparatus of claim 8 further including an airflow control valve and wherein the micro-pump is stationary with respect to the air channeling means, the volume of air being channeled by the pump being determined by the airflow control valve.

11. The apparatus of claim 8 wherein the drops expelled by the micro-pump have a number mean diameter suitable for producing combustion and of less than about 1 mm.

12. The apparatus of claim 8 further including an electrical control circuit connected to the apparatus wherein the output of combustible vapor from the apparatus is controlled in accordance with the power requirements of an internal combustion engine.

13. The apparatus of claim 8 wherein the micro-pump includes:

a housing;

a pressure regulator connected to the housing;

a combustible liquid inlet conduit in fluid communication with the pressure regulator; and a drop ejector on the housing and in fluid communication with the pressure regulator, said drop ejector containing a nozzle capable of ejecting a combustible liquid in a drop-by-drop fashion from the drop ejector.

14. The apparatus of claim 8 further including a throttle for an internal combustion engine and an internal combustion engine load sensor both connected to the apparatus, the output of combustible vapor from the apparatus being determined by both the throttle and the load sensor.

15. A micro-pump for combustible fluid, comprising:

a housing having a inlet conduit;

a back-pressure regulator disposed within the housing in fluid communication with the inlet conduit; and a quantum drop ejector on the housing and in fluid communication with the back-pressure regulator, said quantum drop ejector containing a set of nozzles capable of discretely ejecting a combustible liquid in a digital manner.

16. The micro-pump of claim 15 wherein the quantum drops expelled by the nozzles have a number mean diameter of less than about 30 um.

17. The micro-pump of claim 15 wherein the set of nozzles includes a plurality of nozzles that are individually stimulated to produce drops at a variable firing frequency.

18. The micro-pump of claim 17 wherein the variable firing frequency is capable of varying in accordance with the power requirements of an internal combustion engine.

19. An apparatus for generating a combustible vapor; comprising:

the micro-pump of claim 15; and means, connected to the micro-pump, for channeling a stream of air through the drops ejected by the micro-pump thereby generating the combustible vapor.

20. The micro-pump of claim 15, wherein said drop ejector includes a plurality of firing chambers and a plurality of corresponding energy dissipation elements configured to selectively cause drops of combustible fluid to be ejected from said firing chambers.

21. The micro-pump of claim 20, wherein said energy dissipation elements are resistors.

22. An apparatus for generating a combustible vapor, comprising:

means for ejecting a set of discrete quantum sized combustible liquid drops; and means, connected to the means for ejecting, for channeling a stream of air through the drops ejected by the means for ejecting thereby generating the combustible vapor.

23. The apparatus of claim 22 further including means, connected to the means for ejecting, for positioning the means for ejecting with respect to the means for channeling and thereby determining the volume of air channeled through the drops.

24. The apparatus of claim 22 wherein said means for channeling further includes an airflow control valve and wherein the means for ejecting is stationary with respect to the means for channeling, the volume of air being channeled through the drops being determined by the airflow control valve.

25. The apparatus of claim 22 wherein the drops expelled by the means for ejecting having a number mean diameter of less than about 30 um.

26. The apparatus of claim 22 further including an electrical control circuit connected to the apparatus wherein the output of combustible vapor from the apparatus is capable of being controlled in accordance with the power requirements of an internal combustion engine.

27. The apparatus of claim 22 wherein the means for ejecting is removable from the means for channeling and replaceable with a new means for ejecting.

28. A combustible fuel device including the apparatus of claim 22.

29. The combustible fuel device of claim 28 wherein the combustible fuel device is selected from the group consisting of:

an internal combustion engine;

a portable heater;

a generator;

a furnace;

a light source; and a stove.

30. The apparatus of claim 22 wherein the means for ejecting includes:

a housing having a combustible liquid inlet conduit;

a back-pressure regulator disposed within the housing in fluid communication with the combustible liquid inlet conduit; and a quantum drop ejector on the housing and in fluid communication with the back-pressure regulator, said quantum drop ejector containing at least one nozzle capable of ejecting a combustible liquid in discretely sized drops.

31. The apparatus of claim 22 further including means for throttling a supplied combustible liquid and means for sensing load on a combustible fuel device, both means connected to the apparatus, the output of combustible vapor from the apparatus being determined by both the means for throttling and the means for sensing load.

32. An apparatus for generating a combustible vapor, comprising:

means for ejecting a set of discrete quantum sized combustible liquid drops;

means for supplying a backpressure to the means for ejecting, said means connected to a low pressurized combustible liquid; and means, connected to the means for ejecting, for channeling a stream of air through the ejected drops thereby atomizing the ejected drops thereby creating the combustible vapor.

33. A method for generating a combustible vapor for an internal combustion engine, comprising the steps of:

ejecting a combustible liquid drop-by-drop from a micro-pump; and channeling a stream of air though the drops ejected by the micro-pump, thereby generating a combustible vapor for an internal combustion engine.

34. The method of claim 33 further including the steps of:

sensing a throttle position from the apparatus;

varying the rate at which drops are ejected from the micro-pump in accordance with the throttle position; and varying the amount of air channeled by the apparatus by throttle position.

35. The method of claim 33 further including the steps of:

sensing an engine load signal from the internal combustion engine; and varying the rate at which drops are ejected from the micro-pump in accordance with the engine load.

36. The method of claim 33 further including the steps of:

sensing a throttle position;

sensing an engine load signal from the internal combustion engine;

generating a combined signal from the throttle position signal and the engine load signal; and varying the rate at which drops are ejected from the micro-pump in accordance with the combined signal.

37. A method for generating a combustible vapor, comprising the steps of:

ejecting a combustible liquid in discrete quantum drops from a micro-pump; and channeling a stream of air through the drops ejected by the micro-pump, thereby generating a combustible vapor.

38. The method of claim 37 further including the steps of:

sensing a throttle position from a fuel consuming apparatus;

varying the rate at which drops are ejected from the micro-pump in accordance with the throttle position; and varying the amount of air channeled with respect to the throttle position.

39. The method of claim 37 further including the steps of:

sensing a load signal from a combustible fuel device; and varying the rate at which drops are ejected from the micro-pump in accordance with the sensed load signal.

40. The method of claim 37 further including the steps of:

sensing a throttle position;

sensing a load signal from a combustible fuel device;

generating a combined signal from the throttle position signal and the sensed load signal; and varying the rate at which drops are ejected from the micro-pump in accordance wit the combined signal.

41. A fuel injection device, comprising:

a drop ejector configured to eject discrete drops of combustible fluid; and means for channeling a stream of air through the ejected drops thereby atomizing the ejected drops and creating a combustible vapor.

42. The fuel injection device of claim 41, whereby said drop ejector includes a plurality of firing chambers and a plurality of corresponding energy dissipation elements configured to selectively cause said droplets of combustible fluid to be ejected from said firing chambers.

43. The fuel injection device of claim 42, wherein said energy dissipation elements comprise resistors.

44. A method for generating a combustible vapor for an internal combustion engine, comprising the steps of:

ejecting discrete drops of a combustible liquid from a micro-pump; and channeling a stream of air though the drops ejected by the micro-pump, thereby generating a combustible vapor for an internal combustion engine.

45. The method of claim 44, wherein said step of ejecting discrete drops of a combustible liquid from a micro-pump comprises stimulating at least one energy dissipation element, which causes a drop of combustible liquid to be ejected from said micro-pump.

* * * * *

UNITED STATES PATENT AND TRADEMARK OFFICE

CERTIFICATE OF CORRECTION

PATENT NO. : 6,729,306 B2
DATED : May 4, 2004
INVENTOR(S) : Koegler, III et al.

It is certified that error appears in the above-identified patent and that said Letters Patent is hereby corrected as shown below:

Column 10,
Line 53, between “fashion” and “from”, insert -- directly --.

Column 11,
Line 4, after “ejected”, insert -- directly --.
Line 51, delete “a inlet” and insert therefor -- an inlet --.
Line 57, delete the entire line and insert therefor -- configured to eject drops of a combustible liquid directly from the nozzles. --
Line 58, delete the entire line.

Column 12,
Line 10, after “ejected”, insert -- directly --.

Column 13,
Line 10, delete “drops;” and insert therefor -- drop directly from one or more nozzles; --.
Line 21, between “drop-by-drop” and “from”, insert -- directly --.
Line 23, delete “though” and insert therefor -- through --.

Signed and Sealed this

Twenty-fourth Day of August, 2004

JON W. DUDAS
*Director of the United States Patent and Trademark Office*